US007064488B2

(12) United States Patent
Tomiyoshi et al.

(10) Patent No.: US 7,064,488 B2
(45) Date of Patent: Jun. 20, 2006

(54) EASILY-ASSEMBLED COMPACT SELF-BALLASTED FLUORESCENT LAMP

(75) Inventors: Yasushige Tomiyoshi, Takatsuki (JP); Kenji Itaya, Takatsuki (JP); Akiko Nakanishi, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 243 days.

(21) Appl. No.: 10/780,216

(22) Filed: Feb. 17, 2004

(65) Prior Publication Data

US 2004/0218385 A1 Nov. 4, 2004

(30) Foreign Application Priority Data

Feb. 28, 2003 (JP) ..... 2003-055002

(51) Int. Cl.
*H01J 17/16* (2006.01)

(52) U.S. Cl. ..... 313/634; 313/493; 362/216

(58) Field of Classification Search ..... 313/623, 313/493, 634, 485–487; 362/216, 260, 363, 362/294; 445/22, 26, 27
See application file for complete search history.

(56) References Cited

U.S. PATENT DOCUMENTS

| | | | | |
|---|---|---|---|---|
| 6,633,128 | B1 * | 10/2003 | Ilyes et al. | 313/634 |
| 2002/0190625 | A1 * | 12/2002 | Tokes et al. | 313/318.01 |
| 2003/0234614 | A1 * | 12/2003 | Itaya et al. | 313/634 |
| 2004/0263079 | A1 * | 12/2004 | Nakanishi et al. | 313/631 |

FOREIGN PATENT DOCUMENTS

| | | |
|---|---|---|
| JP | 4-277402 | 10/1992 |
| JP | 7-240176 | 9/1995 |
| JP | 10/275592 | 10/1998 |

* cited by examiner

*Primary Examiner*—Edward J. Glick
*Assistant Examiner*—Elizabeth Keaney

(57) ABSTRACT

A compact self-ballasted fluorescent lamp includes an arc tube formed by a glass tube double-spirally wound from its middle to both ends around a spiral axis, and a cylindrical holding member having a closed bottom and holding the arc tube, a case fit to cover a circumferential wall of the holding member, and the like. End-vicinity parts of the glass tube are formed to have a larger gap with glass tube parts adjacent in the direction of the spiral axis. The arc tube is held in a state where the distance L1 between a first point that is on an outer surface of a glass tube part adjacent to one of the ends of the glass tube in the direction of the spiral axis and a second point on a surface of the end wall facing the first point is about 1.5 mm.

8 Claims, 10 Drawing Sheets

EASILY-ASSEMBLED COMPACT SELF-BALLASTED FLUORESCENT LAMP

This application is based on application No. 2003-55002 filed in Japan, the contents of which are hereby incorporated by reference.

BACKGROUND OF THE INVENTION (1) Field of the Invention

The present invention relates to a compact self-ballasted fluorescent lamp including a double-spiral arc tube formed by a glass tube wound from its middle to both ends around an axis of spiral, and a cylindrical holding member holding the arc tube with the ends of the glass tube being inserted through insertion openings formed in the end wall of the holding member.

(2) Related Art

In the present energy-saving era, compact self-ballasted fluorescent lamps have been increasingly widespread as energy-saving light sources alternative to incandescent lamps. As one example, a compact self-ballasted fluorescent lamp includes an arc tube formed by combining three glass tubes bent in U-shapes, a cylindrical holding member that has a closed bottom and holds the arc tube, and a case that is fit to cover the circumferential wall of the holding member. Such a compact self-ballasted fluorescent lamp including an arc tube composed of three U-shaped tubes is hereafter simply referred to as a "3U compact self-ballasted fluorescent lamp".

As shown in FIG. 1, the holding member 920 has, at its end wall 921, three insertion openings 922 through which ends of the three glass tubes are inserted into the holding member 920. The holding member 920 holds the arc tube by bonding the ends of the glass tubes inserted through the insertion openings 922 to the inner surface of the holding member 920 via a bonding agent.

On the inner surface of the case that is fit to cover the circumferential wall 923 of the holding member 920, four projected parts as one example are arranged at fixed intervals in the circumferential direction. On the circumferential wall 923 of the holding member 920, four engagement parts 924 corresponding to the projected parts are formed so that the projected parts and the engagement parts 924 can be engaged together.

The holding member 920 is inserted into the case, so that the engagement parts 924 of the holding member 920 come in contact with the projected parts of the case. The holding member 920 is then further pressed into the case, so that the engagement parts 924 are firmly engaged with the projected parts.

The problem here is that this 3U compact self-ballasted fluorescent lamp is larger than an incandescent lamp. Therefore, the compact self-ballasted fluorescent lamp cannot fit in some lighting fixtures designed for incandescent lamps. To solve this problem, the inventors of the present application made efforts in downsizing compact self-ballasted fluorescent lamps so as to fit in the lighting fixtures designed for incandescent lamps. The inventors of the present application succeeded in obtaining compact self-ballasted fluorescent lamps substantially equal in size to or even smaller than incandescent lamps, by using a double-spiral arc tube formed by a glass tube wound from its middle to both ends around one axis (see for example Japanese Laid-Open Patent Application No. H9-17378).

A holding member for holding such a double-spiral arc tube has, at its end wall, insertion openings through which both ends of a double-spirally wound glass tube are inserted into the holding member. The holding member holds the arc tube by bonding the ends of the glass tube inserted through the openings to the inner surface of the holding member via a bonding agent.

This compact self-ballasted fluorescent lamp however has a problem in that attaching the holding member holding the double-spiral arc tube to the case is difficult, due to the following reason.

In the case of the 3U compact self-ballasted fluorescent lamp shown in FIG. 1, areas (hatched areas in the figure) on the end wall 921 of the holding member 920 can be used to press the holding member 920, to attach the holding member 920 to the case.

In the case of the compact self-ballasted fluorescent lamp using the double-spiral arc tube 950 shown in FIG. 2, however, the end wall 961 of the holding member 960 has no such areas that can be used to press the holding member 960, to attach the holding member 960 to the case.

SUMMARY OF THE INVENTION

In view of the above problems, the object of the present invention is to downsize an arc tube by employing a double-spiral construction and also to provide a compact self-ballasted fluorescent lamp in which for example a holding member can be easily attached to a case.

The above object of the present invention can be achieved by a compact self-ballasted fluorescent lamp, including: an arc tube formed by a glass tube double-spirally wound from a middle to both ends thereof around a predetermined axis; and a cylindrical holding member having an end wall where a pair of insertion openings are formed, and holding the arc tube in a state where both end parts of the glass tube are inserted in the insertion openings, wherein a pitch of (a) each end part and (b) an adjacent spiral part in a direction of the axis is larger than a pitch of other adjacent spiral parts, to widen a gap between each end part and the adjacent spiral part, and a minimum distance between (a) a first area that is on an outer surface of a spiral part adjacent to one of the ends in the direction of the axis and (b) a second area that is on a surface of the end wall and that faces the first area, is in a range of 1.5 to 4.0 mm inclusive.

According to this construction, a certain gap can be provided between the surface of the end wall and the surface of the spiral part adjacent to the end part and facing the surface of the end wall. As one example, therefore, the end wall of the holding member can be pressed by utilizing this gap, to attach the holding member to the case.

BRIEF DESCRIPTION OF THE DRAWINGS

These and other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENT

The following describes a compact self-ballasted fluorescent lamp relating to a preferred embodiment of the present invention, with reference to FIGS. 3 to 8.

1. Construction (a) Overall Construction

Figure 1:
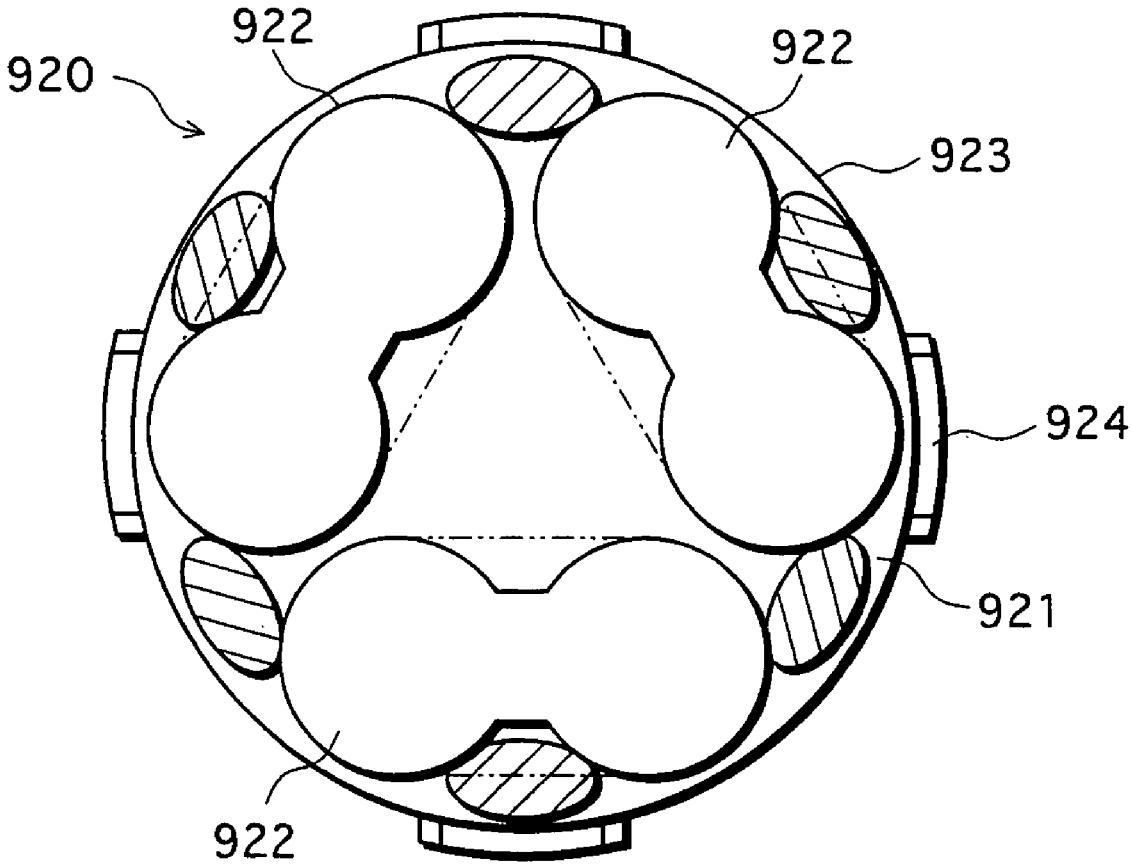
Prior Art FIG. 1
FIG. 1 is a plan view of a holding member used in a conventional 3U compact self-ballasted fluorescent lamp.
Figure 2:
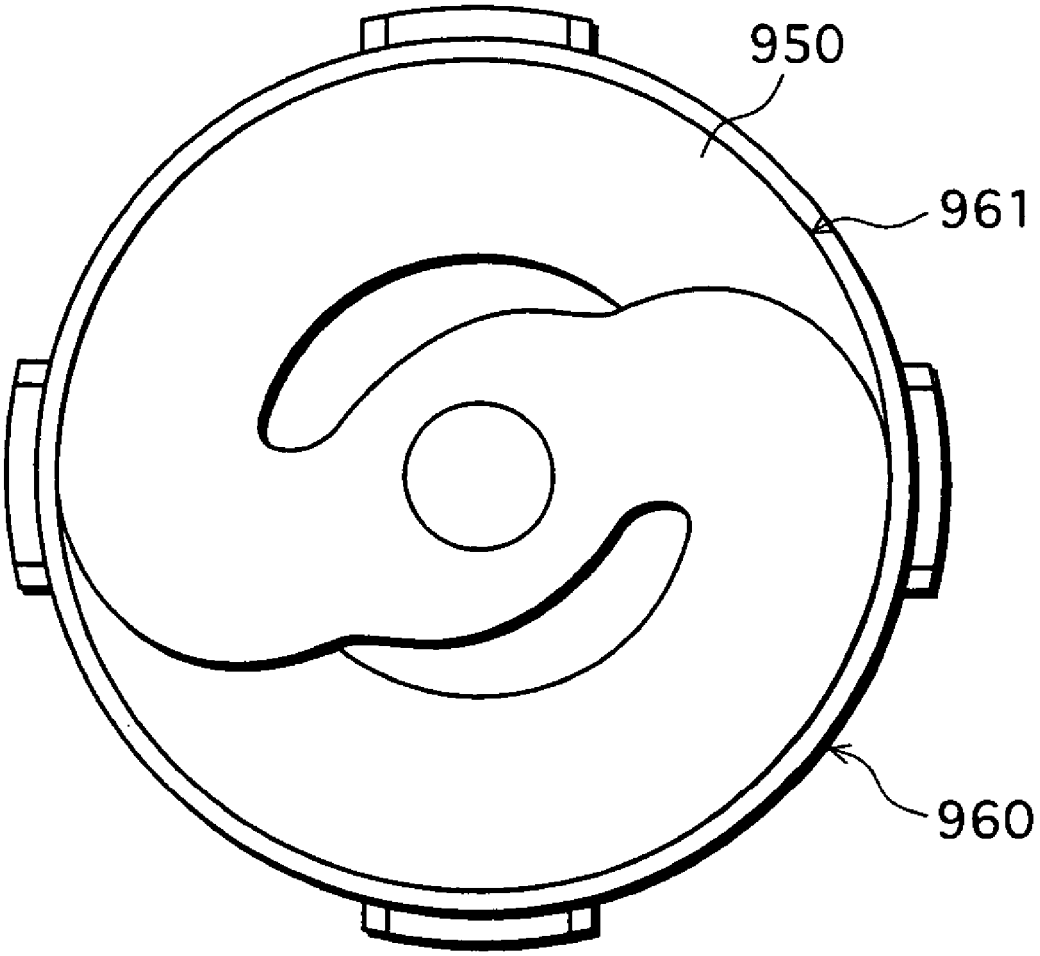
Prior Art FIG.2
FIG. 2 is a plan view of a conventional double-spiral arc tube that has been attached to a holding member.
Figure 3:
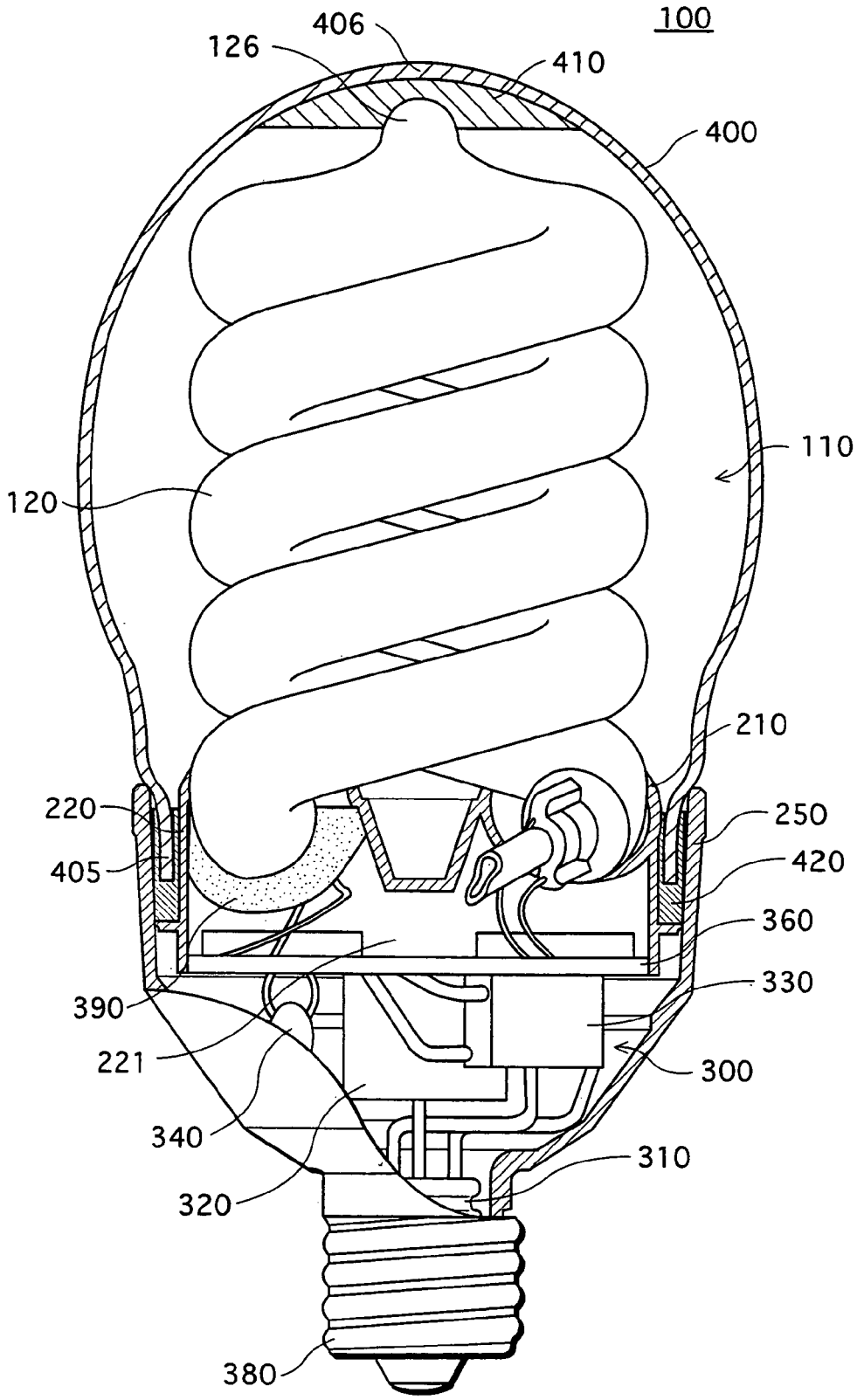
FIG. 3 is a front view of a compact self-ballasted fluorescent lamp relating to a preferred embodiment of the present invention, with being partially cut away.

As shown in FIG. 3, a compact self-ballasted fluorescent lamp 100 relating to the present embodiment includes an arc tube 110, a holding member 210, an electronic ballast 300, a case 250, and a globe 400. The arc tube 110 is formed by a glass tube 120 wound into a double-spiral shape. The holding member 210 has a cylindrical shape having a closed bottom, and holds the arc tube 110. The electronic ballast 300 is attached to the holding member 210, for lighting the arc tube 110. The case 250 has a cone shape, and is fit to cover a circumferential wall 220 of the holding member 210 and to cover the electronic ballast 300. The globe 400 covers the arc tube 110. A base 380 of the same type as that for incandescent lamps is attached to the lower end of the case 250 (the end opposite to the end fit to cover the holding member 210).

The electronic ballast 300 employs a series-inverter method, and includes a plurality of electric components such as capacitors 310, 330, 340, and a choke coil 320. These electric components of the electronic ballast 300 are mounted on a substrate 360, which is attached to the holding member 210.

As in the case of a globe used in incandescent lamps, the globe 400 is made from a glass material that can have a beautiful finish, and is in the "A" shape. It should be noted here that the shape of the globe 400 should not be limited to the "A" shape.

The globe 400 is attached to the holding member 210 and the case 250 by placing its open end 405 between the circumferential wall 220 of the holding member 210 and the circumferential wall of the case 250 that is fit to cover the circumferential wall 220 of the holding member 210. The globe 400 is bonded via a bonding agent 420 filled between the holding member 210 and the case 250.

The inner surface of a top part 406 (top end in FIG. 3) of the globe 400 is thermally connected to a projected part 126 formed at the top (top end in FIG. 3) of the glass tube 120 via a heat-conductive medium 410, specifically, silicone resin.

(b) Arc Tube

Figure 4:
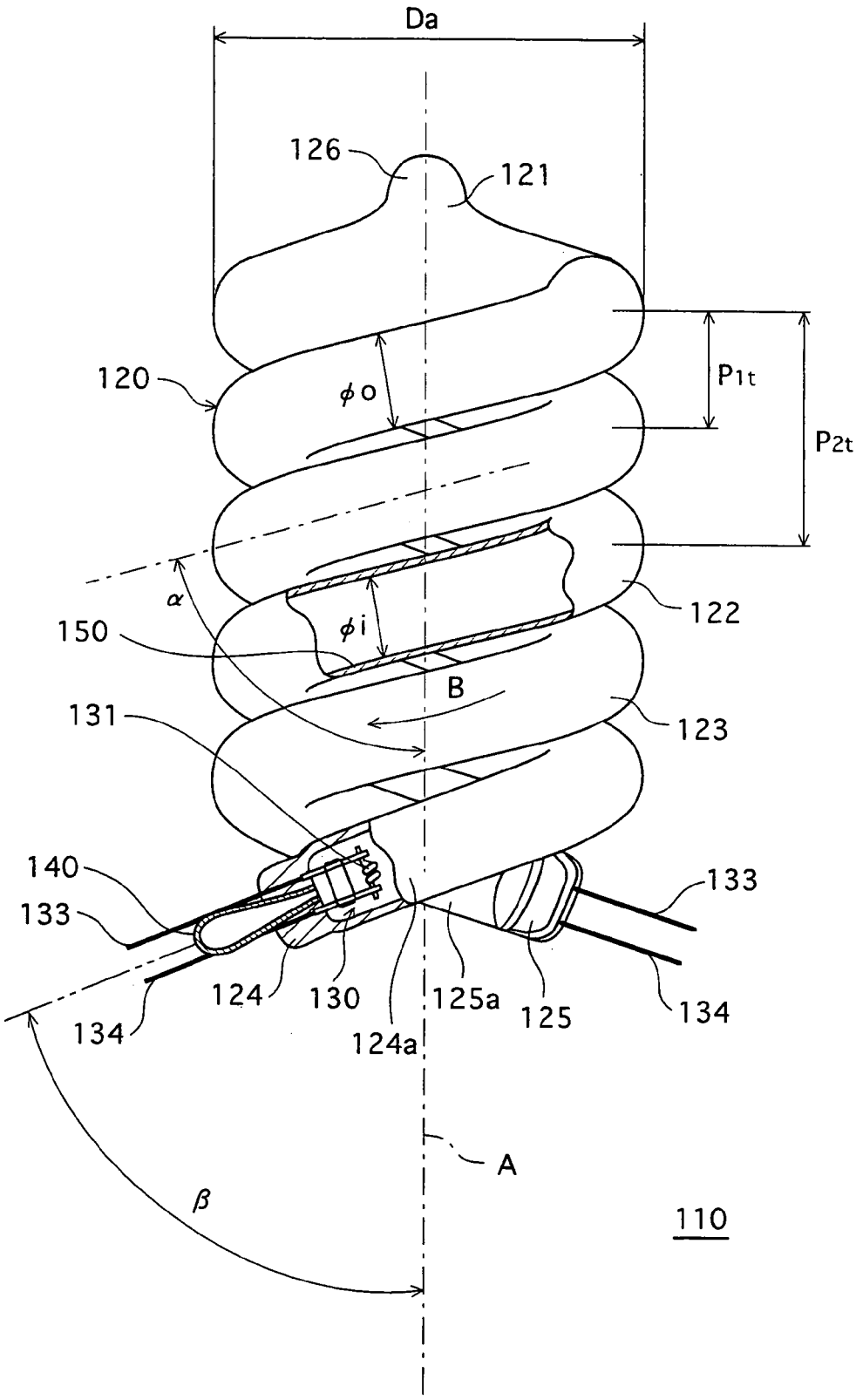
FIG. 4 is a front view of an arc tube relating to the embodiment of the present invention, with being partially cut away.

As shown in FIG. 4, the arc tube 110 has a double-spiral shape, and includes a turning unit 121 formed by turning the glass tube 120 at its middle, and two spiral units 122 and 123 formed by spirally winding glass tube parts that extend from the turning unit 121 to both ends 124 and 125 of the glass tube 120, in the B direction (this direction may be hereafter referred to as the "spiral direction") around the axis A of spiral (spiral axis A). It should be noted here that the ends 124 and 125 of the glass tube 120 referred to in this specification intend to mean the very edges of both ends of the glass tube 120. It should be noted here that the direction parallel to the spiral axis A is hereafter referred to as the "spiral-axis direction".

The glass tube 120 (specifically, each of the spiral units 122 and 123) is wound with substantially the same pitch, i.e., a first pitch, from its middle (corresponding to the turning unit 121) to a predetermined position (hereafter referred to as a "pitch enlarging position" described in detail later), and with a second pitch larger than the first pitch from the pitch enlarging position to the ends 124 and 125 of the glass tube 120 (the parts of the glass tube 120 from the pitch enlarging position to the ends 124 and 125 may be hereafter referred to as "end-vicinity parts"). Due to the second pitch, the ends 124 and 125 are away from glass tube parts that are adjacent to the ends 124 and 125 in the spiral-axis direction. A "pitch" referred to herein is specifically a distance between the central points of the cross sections of two glass tube parts adjacent to each other in the spiral-axis direction.

To be more specific, the glass tube 120 is wound at an inclination angle $\alpha$ with respect to the spiral axis A (hereafter referred to as the "spiral angle"), from its middle (corresponding to the turning unit 121) to the pitch enlarging position, and at an inclination angle $\beta$ smaller than the inclination angle $\alpha$ with respect to the spiral axis A from the pitch enlarging position to the ends 124 and 125.

Due to this, a gap between the end-vicinity part 124*a* (125*a*) and a glass tube part adjacent to the end-vicinity part 124*a* (125*a*) in the spiral-axis direction is larger than a gap between any adjacent glass tube parts positioned between the turning unit 121 to the pitch enlarging position. Further, the gap between the end-vicinity part 124*a* (125*a*) and the adjacent glass tube part widens gradually from the pitch enlarging position toward the end 124 (125).

It should be noted here that soft glass such as strontium-barium silicate glass is used as a material for the glass tube 120.

A pair of electrodes 130 is sealed at the ends 124 and 125 of the glass tube 120. The electrodes 130 each are composed of a filament coil 131 made of tungsten and a pair of lead wires 133 and 134 supporting the filament coil 131 by a bead glass mounting method.

An exhaust tube 140 is sealed, together with the electrode 130, at one of the ends 124 and 125 of the glass tube 120, i.e., the end 124, to exhaust the glass tube 120 to create a vacuum therein or to enclose mercury, a buffer gas, or the like therein as described later. The tip of the exhaust tube 140 is sealed for example by tip-off, after the glass tube 120 is exhausted and mercury and a buffer gas are enclosed.

Within the glass tube 120, about 5 mg of mercury, and argon as a buffer gas are enclosed at a pressure of 600 Pa. As the buffer gas, a mixture gas such as a mixture of argon and neon may also be used.

A phosphor 150 is applied to the inner surface of the glass tube 120. The phosphor 150 used here may be a mixture of three types of rare-earth phosphors respectively emitting red, green, and blue light, e.g., $Y_2O_3$:Eu, $LaPO_4$:Ce, Tb, and $BaMg_2Al_{16}O_{27}$:Eu, Mn.

(c) Holding Member

Figure 5A:
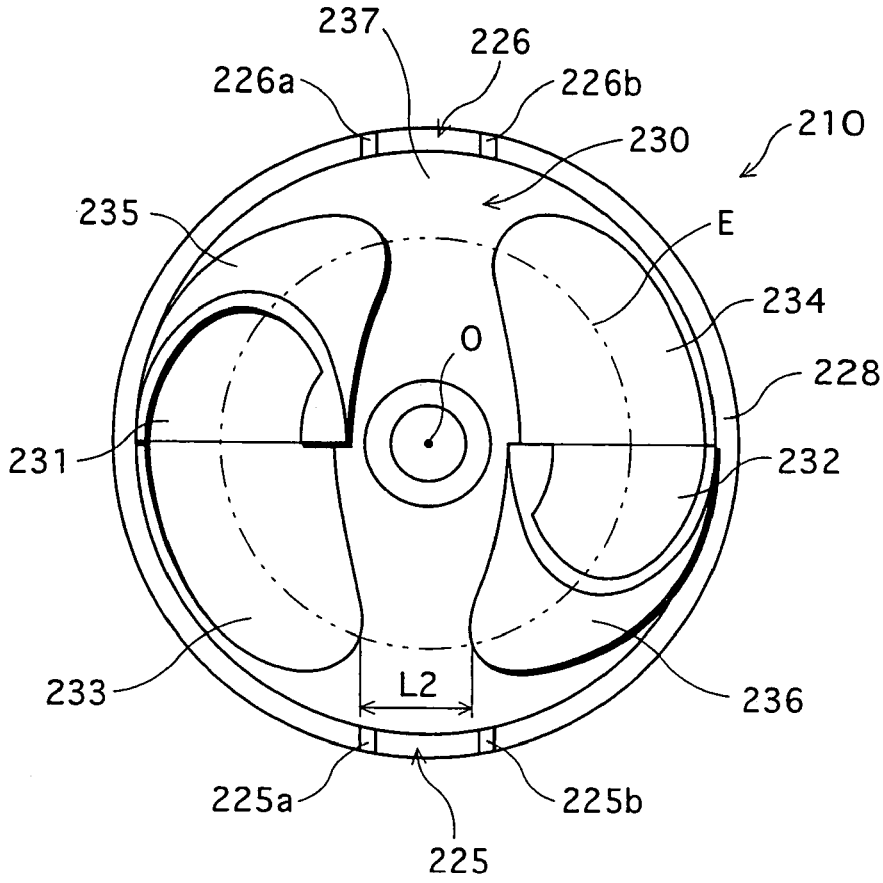
FIG. 5A is a plan view of a holding member relating to the embodiment of the present invention.
Figure 5B:
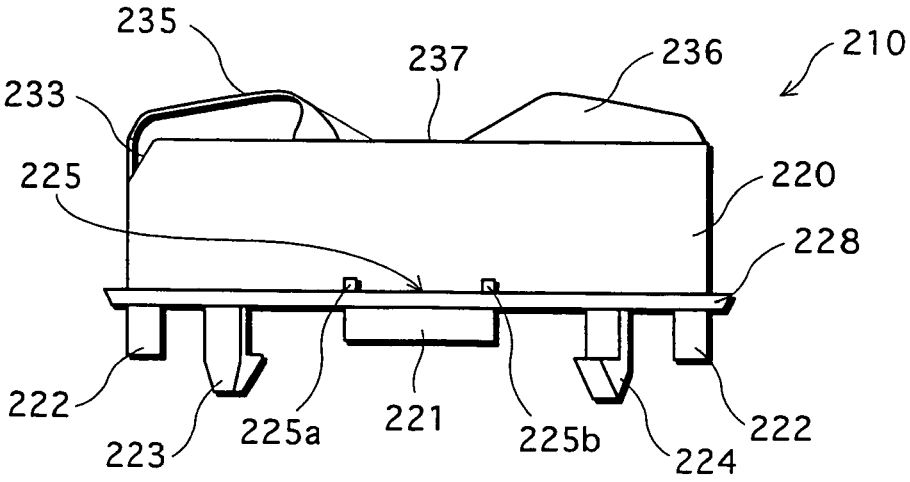
FIG. 5B is a front view of the holding member relating to the embodiment of the present invention.

As shown in FIGS. 3, 5A, and 5B, the holding member 210 is roughly composed of an end wall 230 and a circumferential wall 220. As one example, a synthetic resin material such as PET (polyethylene terephthalate) is used as a material for the holding member 210. This resin has good heat-resistant properties, and also has strong resistance to ultraviolet rays.

The following first describes the end wall 230. The end wall 230 has a pair of tube-holding structures that allow the ends 124 and 125 of the glass tube 120 to be inserted in and held by the holding member 120. The tube-holding structures are respectively composed of insertion openings 231 and 232 through which the ends 124 and 125 of the glass tube 120 are inserted, guide units 233 and 234 for guiding the ends 124 and 125 of the glass tube 120 to the insertion openings 231 and 232, and cover units 235 and 236 for covering the end-vicinity parts 124*a* and 125*a* of the inserted glass tube 120.

Hereafter, one side of each tube-holding structure toward which the end 124 (125) of the glass tube 120 moves in the process of inserting the glass tube 120 into the holding member 210 is referred to as the "lower side", and the other side of the tube-holding structure opposite to the lower side is referred to as the "upper side".

The insertion openings 231 and 232 are formed as a symmetric pair with respect to a central point 0 of the end wall 230. At the upper sides of the insertion openings 231 and 232, the guide units 233 and 234 are formed. As shown in FIG. 5A, the guide units 233 and 234 have such shapes that correspond to the outer shapes of the lower portions of the end-vicinity parts 124*a* and 125*a* of the glass tube 120.

To be more specific, the guide units 233 and 234 are formed as grooves extending along tracks to be left by the outer surface points on the lower portions of the ends 124 and 125 when the arc tube 110 is rotated around the central axis of the holding member 210 in a state where the spiral axis A of the arc tube 110 matches the central axis of the holding member 210. The grooves are formed deeper as being closer to the insertion openings 231 and 232.

With this construction, the arc tube 110 can be attached to the holding member 210 simply by making the end-vicinity parts 124*a* and 125*a* come in contact with the guide units 233 and 234 and rotating the arc tube 110 in the B direction around the spiral axis A (see FIG. 4), or rotating the holding member 210 in the direction opposite to the B direction around its central axis. The guide units 233 and 234 here guide the ends 124 and 125 to the insertion openings 231 and 232 while preventing their positional deviations.

At the lower sides of the insertion openings 231 and 232, the cover units 235 and 236 are formed. The cover units 235 and 236 have such shapes that correspond to the outer shapes of the upper portions of the end-vicinity parts 124*a* and 125*a* of the glass tube 120. To be more specific, the cover units 235 and 236 are formed as arches projecting from the surface of the end wall 230. The arches are formed lower as being less closer to the insertion openings 231 and 232.

As described above, the end-vicinity parts 124*a* and 125*a* are formed in such a manner that the gap between each of the end-vicinity parts 124*a* and 125*a* and the glass tube part adjacent in the spiral-axis direction widens gradually toward each of the ends 124 and 125, and the cover units 235 and 236 are formed accordingly. On the front surface of the end wall 230, therefore, a flat area 237 is formed, in the circumferential direction of the end wall 230, between the two tube-holding structures as shown in FIG. 5B.

To be more specific, on the circumference E of the circle with the center O of the holding member 210, along which the tubular axis of the glass tube 120 wound around the spiral axis A lies, the distance L2 (see FIG. 5A) is provided between the guide unit 233 and the cover unit 236 and between the guide unit 234 and the cover unit 235 adjacent in the circumferential direction as shown in FIG. 5A.

The following then describes the circumferential wall 220 of the holding member 210. As shown in FIG. 3 and FIG. 5B, a pair of substrate supporting units 221, a pair of substrate engagement units 223 and 224, and a pair of contact units 222 are formed on the circumferential wall 220 of the holding member 210. The substrate supporting units 221 are for supporting the substrate 360 on which the electronic ballast 300 is mounted. The substrate engagement units 223 and 224 are to be engaged at one surface of the substrate 360 closer to the base 380. The contact units 222 are for coming in contact with the peripheral edge of the substrate 360.

On the entire peripheral edge of the opening of the circumferential wall 220 (opposite to the end wall 230), a flange unit 228 is formed to project outward. The flange unit 228 has pairs of preventive projected parts 225*a* and 225*b*, and 226*a* and 226*b* that are formed to project toward the end wall 230 (projecting in the upper direction in FIG. 5B) at such positions corresponding to a middle area sandwiched between the pair of tube-holding structures. The preventive projected parts 255*a*, 255*b*, 226*a*, and 226*b* are provided for preventing the case 250 fit to cover the holding member 210 from being rotated around its central axis. Parts of the flange unit 228 sandwiched between the pairs of preventive projected parts 225*a* and 225*b*, and 226*a* and 226*b* serve as engagement parts 225 and 226 to be engaged at the inner surface of the case 250.

As shown in FIG. 3, the holding member 210 having the above construction holds the arc tube 110 in a state where the ends 124 and 125 of the glass tube 120 are inserted through the insertion openings 231 and 232, and the end-vicinity parts 124*a* and 125*a* of the glass tube 120 are bonded to the inner surface of the holding member 210 via silicone resin 390 or the like.

Figure 6:
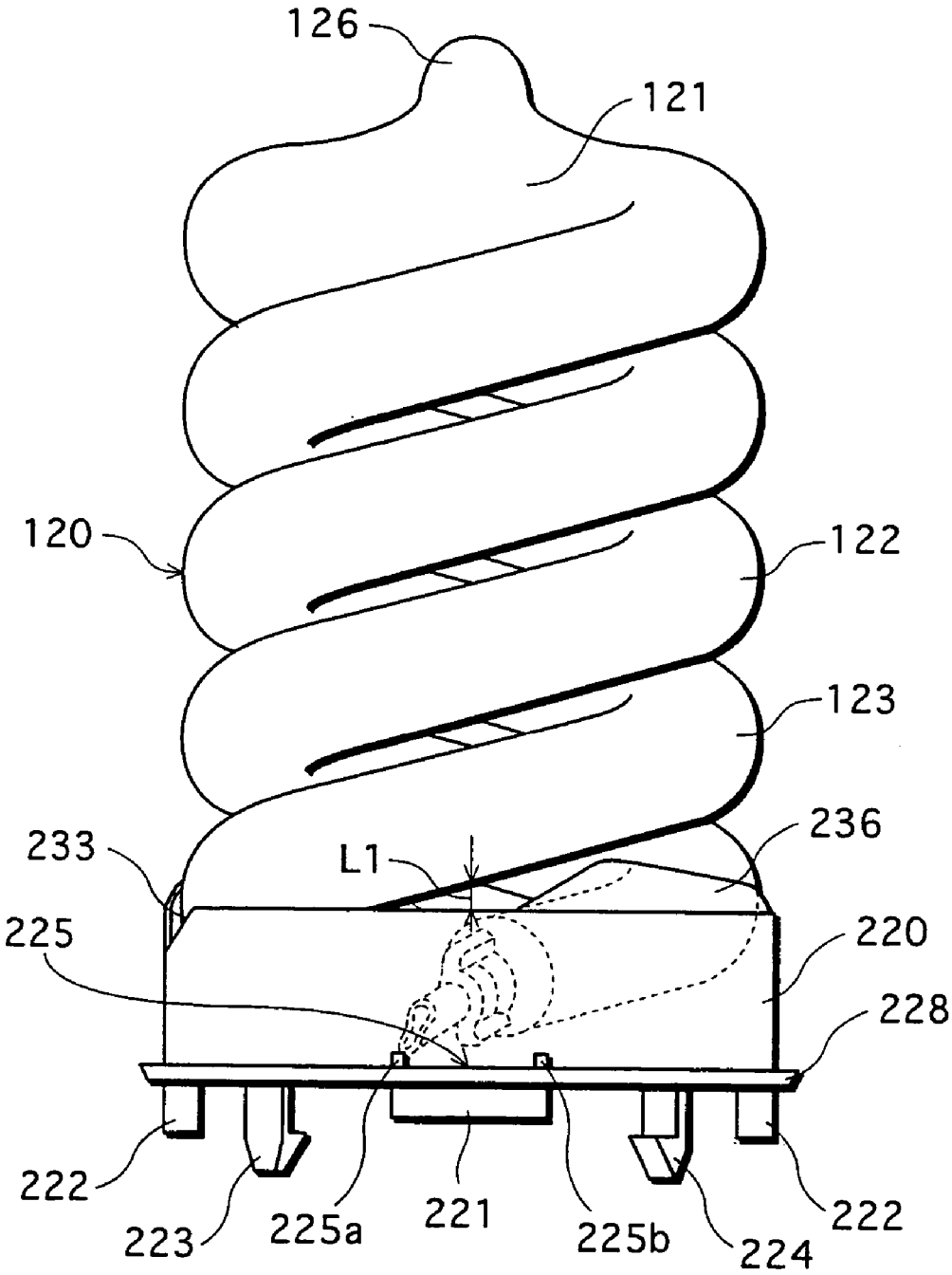
FIG. 6 is a front view of the arc tube held by the holding member relating to the embodiment of the present invention.

Here, the following looks at a distance (gap) between the flat area 237 and the outer surface of a glass tube part facing the flat area 237, specifically, at a middle position of the flat area 237 (referred to as a "flat area middle point") and a position on the outer surface of the glass tube part facing the middle position in the spiral-axis direction (referred to as a "facing glass tube point"). Because the glass tube 120 has a circular cross section, the distance between the flat area middle point and the facing glass tube point becomes at its minimum on the circumference E in a state where the glass tube 120 is attached to the holding member 210 as shown in FIG. 6. The distance becomes larger as the flat area middle point and the facing glass tube point are away outwardly from the circumference E in the diameter direction of the holding member 210. The distance between the flat area middle point and the facing glass tube point taking the minimum value is hereafter referred to as the distance L1. In other words, the distance L1 is a distance between the flat are middle point and the facing glass tube point that are positioned on the circumference E.

(d) Case

Figure 7:
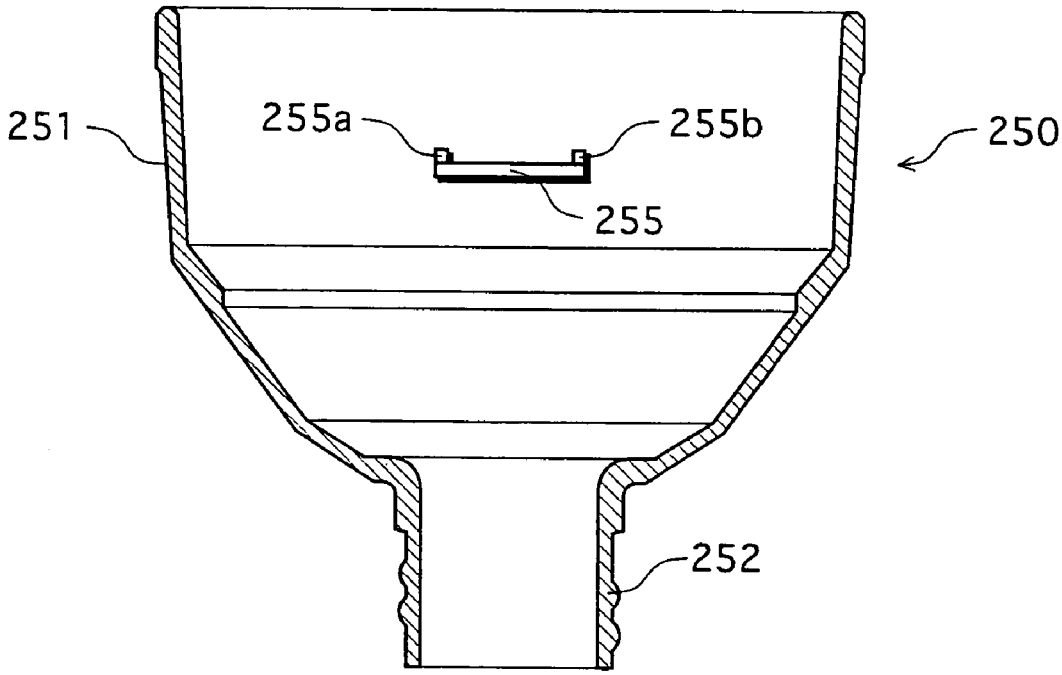
FIG. 7 is a vertical section of a case relating to the embodiment of the present invention.

As shown in FIG. 7, the case 250 has a cone shape, and includes a cylindrical part with a larger opening (hereafter referred to as a large-diameter cylindrical part) 251 that is fit to cover the circumferential wall 220 of the holding member 210, and a cylindrical part with a smaller opening (hereafter referred to as a small-diameter cylindrical part) 252, to which the base 380 shown in FIG. 3 is attached.

At the inner surface of the large-diameter cylindrical part 251, a pair of engagement projected parts 255 are formed at facing positions. The engagement projected parts 255 are to be engaged with the engagement parts 225 and 226 formed on the circumferential wall 220 of the holding member 210. It should be noted here that although FIG. 7 showing a vertical section of the case 250 only illustrates a single engagement projected part 255, "engagement projected part(s) 255" referred to hereafter intends to indicate a pair of engagement projected parts".

As shown in FIG. 7, at both ends of each engagement projected part 255 in the circumferential direction, a pair of preventive projected parts 255*a* and 255*b* are formed to project in the direction where the larger opening is positioned. The preventive projected parts 255*a* and 255*b* are provided for preventing the holding member 210 fit and covered by the case 250 from being rotated around the central axis of the case 250.

2. Specific Constructions

The compact self-ballasted fluorescent lamp 100 relating to the present embodiment corresponds to a 60 W incandescent lamp. Therefore, an arc tube having spiral units 122 and 123 wound by 4.5 winds together is used as the arc tube 110, and an E17-type base is used as the base 380.

The compact self-ballasted fluorescent lamp 100 (globe 400) has a maximum diameter of 55 mm, and a total length of 108 mm, which is smaller than incandescent lamps whose maximum diameter is 60 mm and total length is 110 mm.

The following describes the dimensions of the arc tube 110, with reference to FIG. 4.

The arc tube 110 has an annular outer diameter Da, i.e., a diameter of the arc tube 110 at an outermost circumference of the spirally wound glass tube 120, being 36.5 mm, a tube inner diameter $\phi i$ of the glass tube 120 being 7.4 mm, and a tube outer diameter $\phi o$ of the glass tube 120 being 9 mm. It is preferable that the annular outer diameter Da of the arc tube 110 is 40 mm or smaller, to make the arc tube 110 substantially equal in size to incandescent lamps. Due to a difficulty in the process of shaping the arc tube 110, it is impossible to downsize the arc tube 110 to have the annular outer diameter Da smaller than 30 mm.

It is preferable that the tube outer diameter $\phi o$ of the glass tube 120 is smaller than 10 mm. This is due to the following reason. When the tube outer diameter $\phi o$ is 10 mm or larger, the glass tube 120 has large flexural rigidity, and therefore, it is difficult to spirally wind the glass tube 120 to have the annular outer diameter Da of as small as about 36.5 mm.

The pitch enlarging position is such a position back from the end 124 (125) by 90° with respect to the spiral axis as viewed from below the spirally-wound glass tube 120. Between the turning unit 121 to the pitch enlarging position, the spirally-wound glass tube 120 has a pitch P2t of 20 mm and a pitch P1t of 10 mm. The pitch P2t is a pitch of parts of the spiral unit 122 adjacent in the spiral-axis direction or a pitch of parts of the spiral unit 123 adjacent in the spiral-axis direction (vertical direction in FIG. 4). The pitch P1t is a pitch of a part of the spiral unit 122 and a part of the spiral unit 123 adjacent in the spiral-axis direction.

Accordingly, a minimum gap between glass tube parts adjacent in the direction parallel to the spiral axis A is about 1 mm. It is preferable that this gap is 3 mm or smaller. This is due to the following reason. When the gap is larger than 3 mm, the total length of the arc tube 110 is inevitably long, and also, adjacent glass tube parts are so apart from one another that the problem of uneven illuminance occurs.

The spiral angle $\alpha$ employed between the turning unit 121 to the pitch enlarging position is about 76.7°. The spiral angle $\beta$ employed between the pitch enlarging position and the ends 124 and 125 is about 69.2°.

The distance between the electrodes 130 (between the filament coils 131) within the arc tube 110 is 400 mm. The total length of the arc tube 110 (the distance from the tip of the projected part 126 of the arc tube 110 to its bottom end where the electrodes are sealed in the direction parallel to the spiral axis A) is 62.8 mm, which is smaller than that of a 60 W incandescent lamp.

The circumferential wall 220 of the holding member 210 has an outer diameter of 38.5 mm and a height of about 14.6 mm. An inner diameter of the large-diameter cylindrical part 251 of the case 250 fit to cover the circumferential wall 220 of the holding member 210 is 42.7 mm. The distance L2 between the guide unit 233 (234) and the cover unit 236 (235) is about 7 mm.

On the other hand, in a state where the glass tube 120 with the above-described construction is attached to the holding member 210, the minimum distance L1 (see FIG. 6) between the flat area middle point and the facing glass tube point (the point on the outer surface of the glass tube part adjacent to one of the ends 124 and 125 in the spiral-axis direction) is 1.5 mm. Here, the flat area middle point that serves as a reference point for measuring the minimum distance L1 is specifically a middle point of the distance L2 shown in FIG. 5A, and corresponds to "point that is at a middle of an area sandwiched between the pair of tube-holding structures" referred to in the claims.

It should be noted here that although the present invention is applied to the compact self-ballasted fluorescent lamp corresponding to a 60 W incandescent lamp, the present invention may be applied to compact self-ballasted fluorescent lamps corresponding to incandescent lamps with other wattages. In this case, the dimensions of the arc tube, the total length of the compact self-ballasted fluorescent lamp, the type of the base, etc., are different from those described in the above embodiment.

3. Assembly of the Compact Self-Ballasted Fluorescent Lamp (a) Manufacturing Method for the Arc Tube A part of a straight glass tube to be bent is softened by using a heating furnace or the like, and the glass tube is placed on a mandrel in such manner that a substantially middle of the glass tube is aligned with the top of the mandrel. The mandrel has, at its top and outer surface, a groove corresponding to the double-spiral shape of the arc tube. With the glass tube being placed on the top of the mandrel, the mandrel is rotated. Due to this, the glass tube is wound into the double-spiral shape along the groove formed on the outer surface of the mandrel.

Following this, a projected-part forming mold is placed on the top of this glass tube, to form the projected part 126 of the glass tube 120. The projected-part forming mold has a recessed shape corresponding to the projected part 126. With the projected-part forming mold being placed on the top of the glass tube, pressurized air is blown into the glass tube, to form a projected part on the top of the glass tube. Both ends of the glass tube are then cut out, at such a position where the glass tube can have a predetermined number of winds.

Figure 8A:
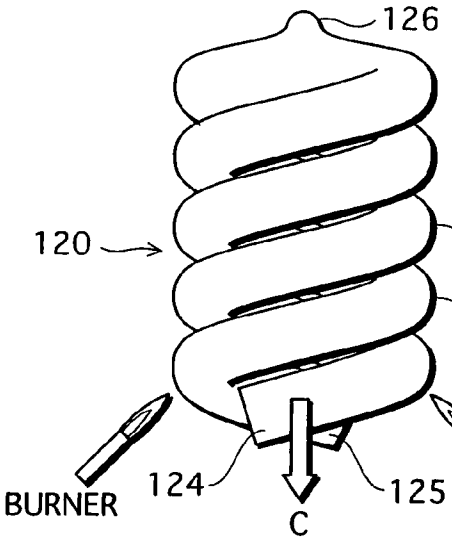
FIGS. 8A to 8C are schematic views for explaining a manufacturing method for a double-spiral arc tube.
Figure 8B:
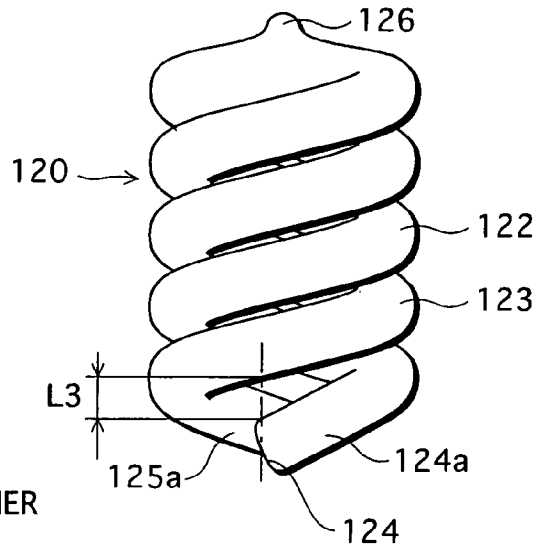
Figure 8C:
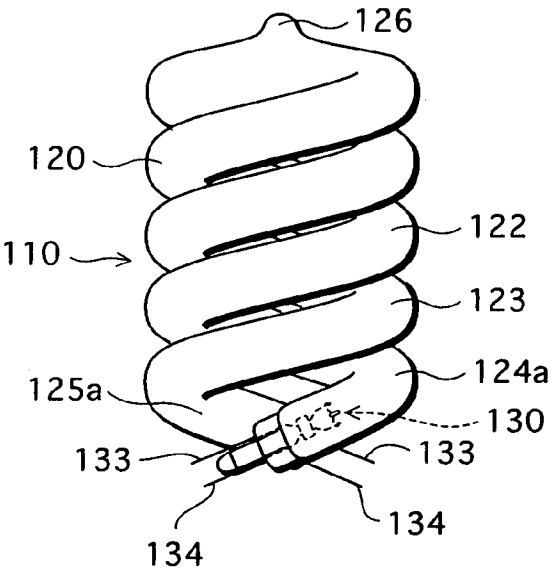
Figure 9C:
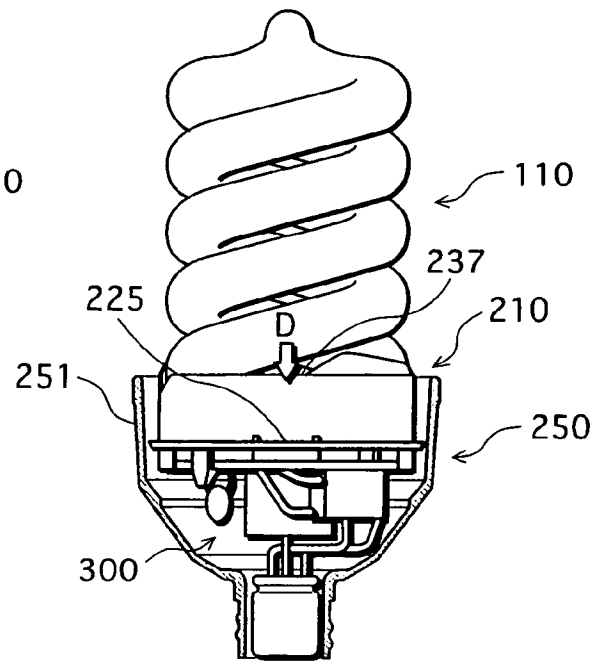
FIGS. 9A to 9C are schematic views for explaining a process for attaching a holding member holding an arc tube to a case.
Figure 9B:
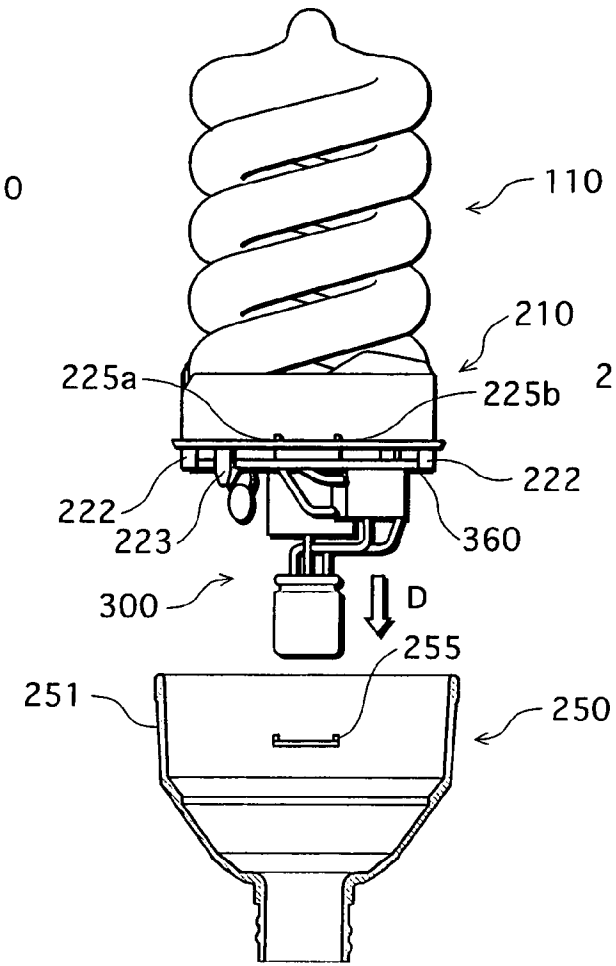
Figure 9A:
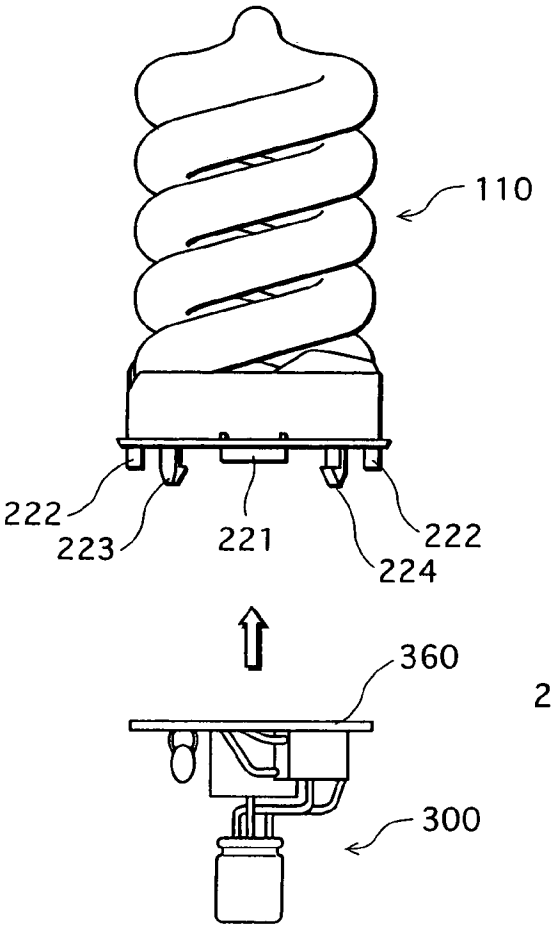

After the ends of the glass tube 120 are cut, parts of the glass tube 120 in the vicinity of the pitch enlarging position are softened by heating them using a burner or the like as shown in FIG. 8A. With these parts of the glass tube 120 being softened, the ends 124 and 125 of the glass tube 120 are pulled in the C direction that is the spiral-axis direction, in such a manner that the gap L3 between the ends 124 and 125 and the spiral units 122 and 123 adjacent to the ends 124 and 125 can be 4.5 mm as shown in FIG. 8B. Here, the point on the end 124 that serves as a reference point for measuring the gap L3 shown in FIG. 8B corresponds to "point that is on each end" referred to in claims.

Here, as the parts of the glass tube 120 to be heated using a burner, the end-vicinity parts 124*a* and 125*a* between the ends 124 and 125 and the pitch enlarging position are not heated entirely, but only parts of the glass tube 120 in the vicinity of the pitch enlarging position are to be locally heated. After this, a phosphor is applied to the inner surface of the glass tube 120 using a well-known method. Electrodes and an exhaust tube are sealed at the ends 124 and 125 of the glass tube 120. Via the exhaust tube, mercury, a buffer gas, etc. are enclosed in the glass tube 120 (see FIG. 8C).

(b) Process for Attaching the Arc Tube to the Holding Member

The following describes the process for attaching the arc tube 110 to the holding member 210.

First, the holding member 210 is fixed in such a manner that the end wall 230 is positioned downward. The ends 124 and 125 of the glass tube 120 are then inserted into the holding member 210 through the insertion openings 231 and 232.

To be more specific, at the upper sides of the insertion openings 231 and 232 of the holding member 210, the guide units 233 and 234 are formed to guide the ends 124 and 125 of the glass tube 120 to the insertion openings 231 and 232. The glass tube 120 and the holding member 210 are set in such a manner that the spiral axis of the arc tube 110 substantially matches the central axis of the holding member 210, and the end-vicinity parts 124*a* and 125*a* of the glass tube 120 are made in contact with the guide units 233 and 234. In this state, the arc tube 110 is rotated using the spiral axis as the rotation axis, so that the ends 124 and 125 are guided to the insertion openings 231 and 232 by the guide units 233 and 234, and are inserted through the insertion openings 231 and 232 into the holding member 210. Alternatively, the glass tube 120 maybe fixed and the holding member 210 maybe rotated.

The ends 124 and 125 of the glass tube 120 are inserted to such positions corresponding to a substantially middle of an area sandwiched between the tube-holding structures of the holding member 210. While this state is being maintained, the end-vicinity parts 124*a* and 125*b* (which may include the ends 124 and 125) of the glass tube 120 are bonded to the inner surface of the holding member 210 via the silicone resin 390. In this way, the arc tube 110 is held by the holding member 210.

Here, a gap between the end-vicinity part 124*a* (125*a*) and a glass tube part adjacent to the end-vicinity part 124*a* (125*a*) in the spiral-axis direction is the widest at the end 124 (125). Further, the ends 124 and 125 of the glass tube 120 are positioned right below the flat area 237 of the holding member 210. As shown in FIG. 6, therefore, a distance of 1.5 mm or more can be secured as the minimum distance L1 between the flat area 237 of the holding member 210 and the outer surface of the glass tube part facing the flat area 237.

Further, as described above for the construction of the holding member 210, the distance between the flat area middle point and the facing glass tube point is larger as the flat are middle point and the facing glass tube point are closer to the peripheral edge of the holding member 210. This means that a space provided over the flat area 237 of the holding member 210 is larger as being closer to the peripheral edge of the holding member 210. It should be noted here that this space is just as large as a space in which a fingertip of a human hand can be managed to be slipped in.

(c) Process for Attaching the Holding Member to the Case

The following describes the process for attaching the substrate 360 on which the electric components constituting the electronic ballast 300 are mounted to the holding member 210 to which the arc tube 110 has been attached by the above-described process. The surface of the substrate 360 on which the electric components are not mounted is placed on the side of the holding member 210 where the arc tube 110 is attached, and the peripheral edge of the substrate 360 is made in contact with the inner surfaces of the contact units 222 of the holding member 210. Here, the substrate engagement units 223 and 224 of the holding member 210 are engaged at the surface of the substrate 360 where the electric components are mounted.

At this time, the surface of the substrate 360 at the side where the arc tube 110 is positioned (the surface opposite to the surface where the electric components are mounted) is supported by the substrate supporting units 221. Therefore, the substrate 360 is aligned in the spiral-axis direction. Also, the peripheral edge of the substrate 360 partially comes in contact with the inner surfaces of the contact units 222 of the holding member 210. Therefore, the substrate 360 is also aligned in the direction perpendicular to the spiral-axis direction.

Following this, the case 250 is fit to cover the circumferential wall 220 of the holding member 210 to which the arc tube 110 and the electronic ballast 300 have been attached. To be more specific, the holding member 210 and the case 250 are aligned in such a manner that the positions of the engagement parts 225 and 226 provided on the flange unit 228 on the circumferential wall 220 of the holding member 210 substantially match the positions of the engagement projected parts 255 of the case 250 in the direction parallel to the central axis of the case 250.

With this positioning, the holding member 210 is inserted into the case 250 by, for example, aligning the holding member 210 in the D direction that is the spiral-axis direction, in such a manner that the engagement parts 225 and 226 of the holding member 210 come in contact with the engagement projected parts 255 of the case 250. Then, by further pressing the flat area 237 of the end wall 230 of the holding member 210 in the D direction, the engagement parts 225 and 226 are engaged with the engagement projected parts 255.

Here, such a space that allows a human fingertip to be managed to be slipped in is provided between the flat area 237 formed on the front surface of the end wall 230 and a glass tube part right above the flat area 237. Therefore, the flat area 237 can be pressed, so that the holding member 210 can be easily attached to the case 250.

Further, the engagement parts 225 and 226 to be engaged with the engagement projected parts 255 of the case 250 are formed at positions on the circumferential wall 220 corresponding to the flat area 237 to be used to press the end wall 230 to attach the holding member 210 to the case 250. Therefore, the pressure applied to the flat area 237 can be efficiently conveyed to the engagement parts 225 and 226.

After this, the globe 400, the base 380, etc., are attached using conventional methods. Although the present embodiment describes the case where the present invention is applied to a compact self-ballasted fluorescent lamp with a globe (outer tube bulb) covering an arc tube, the present invention may be applied to a compact self-ballasted fluorescent lamp without a globe.

<Modifications>

Although the present invention is described based on the above embodiment, the contents of the present invention should not be limited to specific examples shown in the above embodiment. For example, the following modifications are possible.

1. Distance Between the End Wall Surface and the Glass Tube Outer Surface

Although the above embodiment describes the case where the distance between the flat area middle point and the facing glass tube point is 1.5 mm, this distance may be in a range of 1.5 to 4.0 mm inclusive.

This range is determined due to the following reason. When the distance is smaller than 1.5 mm, a space large enough to be used to press the end wall to attach the holding member to the case cannot be provided over the flat area.

When the distance is larger than 4.0 mm, a space large enough to be used to press the end wall can be provided over the flat area, but the total length of the compact self-ballasted fluorescent lamp is inevitably long.

It should be noted here that the above distance is set depending on the spiral pitch of the end-vicinity parts of the glass tube, the positioning of the glass tube attached to the holding member, and the like.

2. Glass Tube (a) Pitch Enlarging Position

Although the above embodiment describes the case where the pitch enlarging position is such a position back from the ends of the spirally-wound glass tube by 90° with respect to the spiral axis as viewed from below the spirally-wound glass tube, the pitch enlarging position may not be limited to such. The angle with respect to the spiral axis by which the pitch enlarging position is back from the ends may be in a range of 60 to 120° inclusive.

This range is determined due to the following reason. When the angle is smaller than 60°, an area of bonding between the end-vicinity parts of the glass tube and the holding member via silicone resin is so small that the holding member cannot firmly hold the arc tube. When the angle is larger than 120°, the gap between the flat area of the holding member and the glass tube part right above the flat area is so large that the entire size of the compact self-ballasted fluorescent lamp becomes large.

(b) Gap between the End and the Spiral Unit

Although the above embodiment describes the case where the gap L3 between the ends and the spiral units adjacent to the ends (this gap is hereafter referred to as the "end/spiral-unit gap") is about 4.5 mm, the end/spiral-unit gap may be in a range of 3 to 6 mm inclusive.

This range is determined due to the following reason. When the end/spiral-unit gap is smaller than 3 mm, the gap between the flat area and the glass tube part right above the flat area is smaller than 1.5 mm in a state where the holding member holds the arc tube. In this case, a space large enough to be used to press the end wall to attach the holding member to the case cannot be provided over the flat area.

When the end/spiral-unit gap is larger than 6 mm, a space large enough to be used to press the end wall can be provided over the flat area, but the total length of the compact self-ballasted fluorescent lamp is inevitably long.

(c) Tube Diameter

Although the above embodiment describes the case where the tube inner diameter of the glass tube is 7.4 mm, the tube inner diameter may be at any value in a range of 5 to 9 mm. By connecting the top part of the arc tube (the bent part of the glass tube) to the globe via silicone resin, and setting the inner diameter of the glass tube in the above range, the temperature of the arc tube during lighting can be made substantially the same as such a temperature that enables the luminous flux produced by the arc tube to be substantially the maximum.

3. Tube-Holding Structure of the Holding Member

The above embodiment describes the case where the pair of tube-holding structures each including the insertion opening, the guide unit, and the cover unit are formed in the end wall of the holding member. Although it is preferable that the tube-holding structure includes all of the insertion opening, the guide unit, and the cover unit, the tube-holding structure may not include, for example, the guide unit. In this case, an opening is to be formed instead of the guide unit, to serve as the insertion opening. Alternatively, the tube-holding structure may not include the cover unit. In this case, an opening is to be formed instead of the cover unit, to serve as the insertion opening.

4. Method for Attaching the Holding Member to the Case

The above embodiment describes the case where the method for attaching the holding member to the case is such that the engagement parts projecting outward from the circumferential wall of the holding member are engaged with the engagement projected parts projecting inward from the large-diameter cylindrical part of the case. However, methods other than this may be employed. For example, engagement holes or engagement recessed parts may be formed in the circumferential wall of the holding member, and the engagement parts of the case may be engaged with the engagement holes or the engagement recessed parts.

5. Positional Relationship between the Holding Member and the Glass Tube End

The ends of the glass tube are inserted in the holding member and fixed, in such a manner that the ends are positioned at a substantially middle of an area sandwiched between the tube-holding structures formed in the end wall as viewed from above. However, the positioning of the ends of the glass tube may not be limited to such. As long as the end-vicinity parts of the glass tube are formed in such a manner that the gap between the end-vicinity part and the glass tube part adjacent to the end-vicinity part in the spiral-axis direction widens toward the end of the glass tube, and the end-vicinity parts are converted by the cover units formed in the end wall, a space to be used to press the end wall can be formed between the flat area of the holding member and the glass tube part right above the flat area as described in the above embodiment.

6. Fluorescent Lamp

Figure 10:
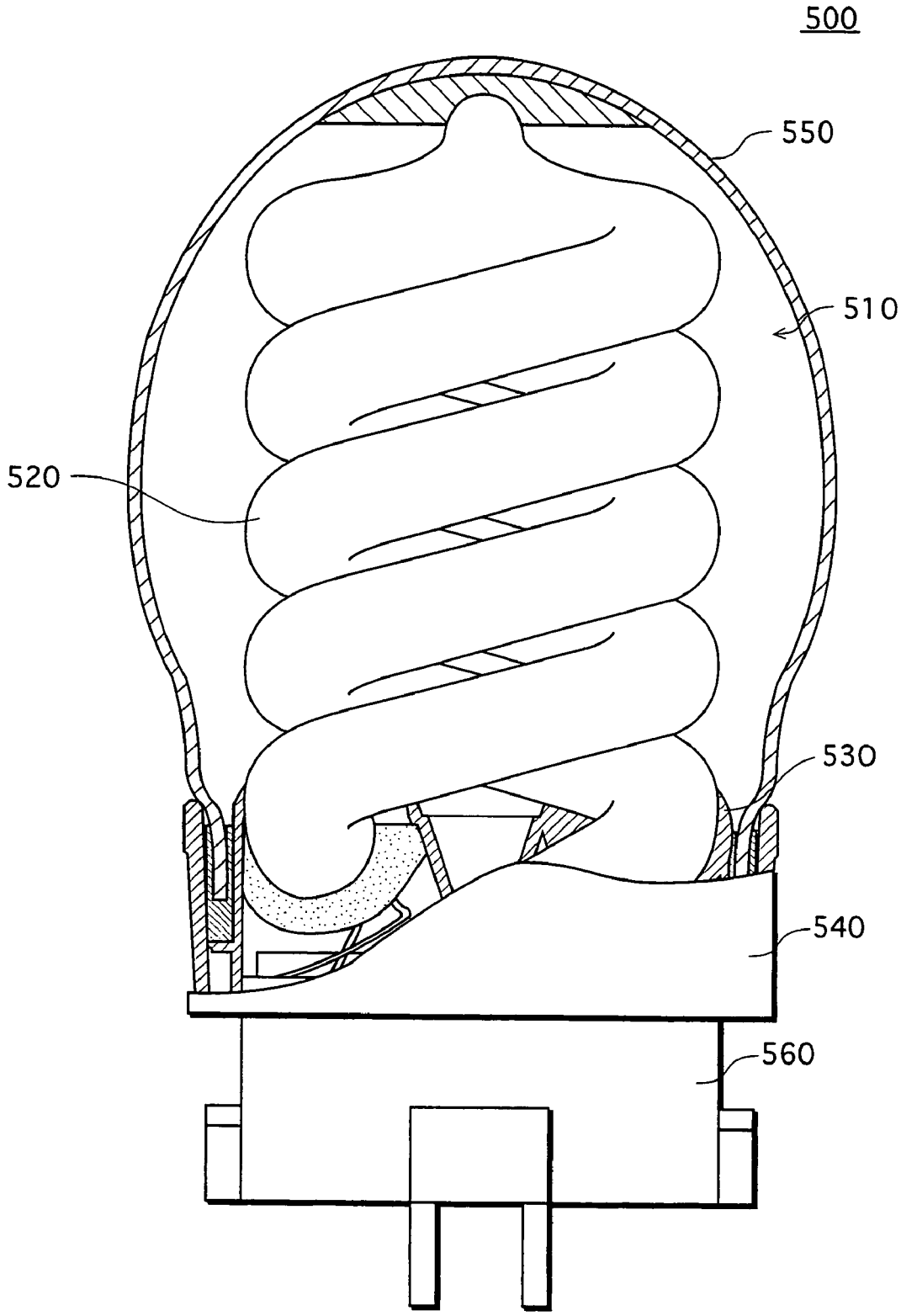
FIG. 10 is a front view of a fluorescent lamp to which the present invention is applied.

Although the above embodiment describes the case where the present invention is applied to a compact self-ballasted fluorescent lamp, the present invention can be applied for example to a fluorescent lamp shown in FIG. 10.

This fluorescent lamp 500 includes a double-spiral arc tube 510 formed by a glass tube 520 spirally wound to its ends, a holding member 530 that is in a cylindrical shape with a closed bottom for holding the arc tube 510 (the end-vicinity parts of the glass tube 520), a case 540 fit to cover the circumferential wall of the holding member 530, a globe 550 covering the arc tube 510, and a single base 560 (e.g., GX10q type) to be fit in a socket of a lighting fixture and receiving power supply. The fluorescent lamp 500 differs from the above compact self-ballasted fluorescent lamp 100 in that an electronic ballast is not contained in the holding member 530 and the case 540, and in that the base 560 is not a screw-type base used as well for incandescent lamps.

(a) Dimensions of the Arc Tube

The above embodiment describes the case where the present invention is applied to a compact self-ballasted fluorescent lamp alternative to an incandescent lamp. Therefore, the compact self-ballasted fluorescent lamp is described to have the above dimensions, in particular, the annular outer diameter of the double-spiral shape being 40 mm or smaller, down to about 30 mm. When the present embodiment is applied to the above fluorescent lamp, however, the above limitations on the dimensions of the arc tube can be removed. As one example, the annular outer diameter of the arc tube may be larger than 40 mm.

The spiral angles $\alpha$ and $\beta$ employed to wind the glass tube in a double-spiral shape are determined depending on the targeted annular outer diameter and spiral pitch of the arc tube. Therefore, the spiral angles $\alpha$ and $\beta$ can be set appropriately depending on the targeted annular outer diameter and spiral pitch of the arc tube. It is however preferable that the gap between glass tube parts adjacent in the spiral-axis direction (gap between adjacent parts of different spiral units) is in a range of 1 to 3 mm inclusive. This is due to the limitation in the shaping process and the problem of uneven illuminance as described in the above embodiment.

7. Globe

Although the compact self-ballasted fluorescent lamp 100 relating to the above embodiment and the fluorescent lamp 500 relating to the modification 6 respectively include the globes 400 and 550 covering the arc tubes 110 and 510, the present invention can be applied to a compact self-ballasted fluorescent lamp without a globe, or to a fluorescent lamp without a globe.

For the compact self-ballasted fluorescent lamp without a globe or the fluorescent lamp without a globe, heat generated during lighting is directly released from the arc tube. By setting the tube inner diameter of the glass tube in a range of 5 to 9 mm inclusive, the temperature of the arc tube during lighting becomes substantially the same as such a temperature that enables the luminous flux produced by the arc tube to be substantially the maximum.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A compact self-ballasted fluorescent lamp, comprising:

an arc tube formed by a glass tube double-spirally wound from a middle to both ends thereof around a predetermined axis; and a cylindrical holding member having an end wall on which a pair of tube-holding structures are provided for holding the arc tube in a state where both end parts of the glass tube are inserted in and held by the tube-holding structures, wherein a pitch of (a) each end part and (b) an adjacent spiral part in a direction of the axis is larger than a pitch of other adjacent spiral parts, to widen a gap between each end part and the adjacent spiral part, and a distance between (a) a first point that is at a middle of an area sandwiched between the pair of tube-holding structures in a circumferential direction of the end wall as viewed in the direction of the axis and (b) a second point that is on an outer surface of a spiral part positioned outward with respect to the holding member and facing the first point, is in a range of 1.5 to 4.0 mm inclusive.

2. The compact self-ballasted fluorescent lamp of claim 1, wherein:

a winding pitch of the glass tube is changed to enlarge at such a position back from each end by 60 to 120 inclusive with respect to the axis, as viewed in the direction of the axis.

3. The compact self-ballasted fluorescent lamp of claim 1, wherein a gap between the other adjacent spiral parts is in a range of 1 to 3 mm inclusive, and a distance between (a) a first point that is on each end and (b) a second point that faces the first point and that is on an outer surface of an adjacent spiral part in the direction of the axis, is in a range of 3 to 6 mm inclusive.

4. The compact self-ballasted fluorescent lamp of claim 1, further comprising a case that is fit to cover a circumferential wall of the holding member, wherein the holding member has, at the circumferential wall, an engagement part that is engaged at an inner surface of the case, the engagement part being at such a position corresponding to the middle of the area sandwiched between the pair of tube-holding structures.

5. The compact self-ballasted fluorescent lamp of claim 1, further comprising a globe covering the arc tube; and a case that is fit to cover a circumferential wall of the holding member, wherein a gap is formed between the circumferential wall of the holding member and the case, and the globe is fixed in a state where an opening end thereof is fit in the gap.

6. The compact self-ballasted fluorescent lamp of claim 5, wherein the arc tube is thermally connected to the globe via a heat conductive medium, at a coolest position of the arc tube during lighting, or a position in a vicinity of the coolest position.

7. The compact self-ballasted fluorescent lamp of claim 1, wherein an inner diameter of the glass tube is in a range of 5 to 9 mm inclusive.

8. The compact self-ballasted fluorescent lamp of claim 1, wherein an annular outer diameter of the double-spiral arc tube is in a range of 30 to 40 mm inclusive.

* * * * *